US008893671B2

(12) United States Patent
Taylor

(10) Patent No.: US 8,893,671 B2
(45) Date of Patent: Nov. 25, 2014

(54) FULL EXPANSION INTERNAL COMBUSTION ENGINE WITH CO-ANNULAR PISTONS

(71) Applicant: Jack R. Taylor, Maineville, OH (US)

(72) Inventor: Jack R. Taylor, Maineville, OH (US)

( * ) Notice: Subject to any disclaimer, the term of this patent is extended or adjusted under 35 U.S.C. 154(b) by 0 days.

(21) Appl. No.: 13/827,353

(22) Filed: Mar. 14, 2013

(65) Prior Publication Data

US 2014/0053810 A1 Feb. 27, 2014

Related U.S. Application Data

(60) Provisional application No. 61/691,908, filed on Aug. 22, 2012.

(51) Int. Cl.
*F02B 75/30* (2006.01)
*F02F 1/24* (2006.01)

(52) U.S. Cl.
CPC ..... *F02F 1/24* (2013.01)
USPC ..... 123/48 C; 123/50 A; 123/52.3; 123/58.2; 123/78 C; 123/197.2

(58) Field of Classification Search
CPC ..... F02B 75/28; F02B 75/285; F02B 75/287; F02B 75/30
USPC .... 123/48 B, 48 C, 50 R, 50 A, 51 A, 51 AA, 123/52.2, 52.3, 58.2, 78 C, 197.2
See application file for complete search history.

(56) References Cited

U.S. PATENT DOCUMENTS

| | | | | |
|---|---|---|---|---|
| 1,361,390 | A * | 12/1920 | MacDonald | 123/51 B |
| 1,718,088 | A * | 6/1929 | Stuver | 123/50 R |
| 2,067,496 | A * | 1/1937 | McCarthy | 123/50 R |
| 3,941,349 | A | 3/1976 | Pierson | |
| 4,077,382 | A | 3/1978 | Gentile | |
| 4,083,331 | A | 4/1978 | Guenther | |
| 4,164,916 | A * | 8/1979 | Wuerfel | 123/78 C |
| 4,501,238 | A | 2/1985 | Odum | |
| 4,715,332 | A | 12/1987 | Kreuter | |
| 4,887,559 | A | 12/1989 | Hensel et al. | |
| 4,930,465 | A | 6/1990 | Wakeman et al. | |
| 4,949,215 | A | 8/1990 | Studtmann et al. | |
| 4,976,232 | A | 12/1990 | Coates | |
| 4,997,004 | A | 3/1991 | Barkhimer | |

(Continued)

OTHER PUBLICATIONS

Tour Engine, Inc. brochure downloaded from www.tourengine.com on Oct. 5, 2011 (2 pages).

*Primary Examiner* — Erick Solis
(74) *Attorney, Agent, or Firm* — Hasse & Nesbitt LLC; Daniel F. Nesbitt

(57) ABSTRACT

A cylinder for an internal combustion engine having co-annular dual pistons. The cylinder has a main cylinder having a main cylinder wall and a cylinder head, a first or outer piston having an annular crown, an inner cylinder wall that defines an inner cylinder, and an annular outer sidewall extending from the periphery of the crown, an inner piston having a crown, and an annular inner sidewall extending from the periphery of the crown. A solenoid-actuated pin selectively secures the outer piston with the main cylinder during a portion of each cylinder cycle. The inner piston reciprocates within the inner cylinder during both the air inlet and compression strokes, while the outer piston reciprocates within the main cylinder only during the power stroke and the exhaust stroke, to increase the piston crown surface area exposed to the combustion gases to maximize the power and efficiency.

12 Claims, 12 Drawing Sheets

(56) References Cited

U.S. PATENT DOCUMENTS

| | | | | |
|---|---|---|---|---|
| 5,009,201 | A | 4/1991 | Morikawa | |
| 5,494,255 | A | 2/1996 | Pearson et al. | |
| 5,638,781 | A | 6/1997 | Sturman | |
| 5,839,400 | A | 11/1998 | Vattaneo et al. | |
| 6,164,323 | A | 12/2000 | Smith et al. | |
| 6,182,646 | B1 | 2/2001 | Silberstein et al. | |
| 6,332,446 | B1 | 12/2001 | Matsumoto et al. | |
| 6,390,048 | B1 | 5/2002 | Luchansky | |
| 6,575,126 | B2 | 6/2003 | Sturman | |
| 7,273,022 | B2 * | 9/2007 | Valdivia | 123/48 R |
| 7,273,023 | B2 | 9/2007 | Tour et al. | |
| 7,383,797 | B2 | 6/2008 | Tour | |
| 7,516,723 | B2 | 4/2009 | Tour | |
| 8,453,438 | B2 | 6/2013 | Tsubakino et al. | |
| 8,584,629 | B2 | 11/2013 | Tour et al. | |
| 2012/0291743 | A1 * | 11/2012 | Hamby | 123/193.1 |

* cited by examiner

FULL EXPANSION INTERNAL COMBUSTION ENGINE WITH CO-ANNULAR PISTONS

CROSS REFERENCE TO RELATED APPLICATIONS

This application claims the benefit of U.S. Provisional application 61/691,908, filed Aug. 8, 2012, the disclosure of which is incorporated by reference in its entirety.

FIELD OF THE INVENTION

The present invention is in the field of internal combustion (IC) engines, and more particularly high efficiency IC engines.

BACKGROUND OF THE INVENTION

In a conventional Otto cycle internal combustion (IC) engine, the gasoline fuel is injected into the intake manifold to mix with the air and is drawn into the cylinder through the intake valve during the intake stroke. The fuel flow is metered to produce fuel-air ratios that are very close to stoichiometric for all operating conditions. Conventional IC engines are limited in compression ratio by the requirement that the fuel must be burned at stoicheometric premixed fuel-air ratios with no detonation or pre-ignition, which limits the thermal efficiency that can be achieved with these engines. Diesel engines with direct fuel injection can operate at much higher compression ratios and leaner fuel-air ratios with higher efficiency. However, diesel engines use compression ignition of fuel that is not well mixed, resulting in a significant combustion delay time and reduced release of energy at the beginning of the power stroke, which results in reduced efficiency.

SUMMARY OF THE INVENTION

The present invention provides a cylinder for an IC engine having co-annular dual pistons, the cylinder including: i) a main cylinder including a main cylinder wall and a cylinder head, and having at least one exhaust port, an exhaust valve disposed in the exhaust port, and at least one inlet air port, and an inlet air valve disposed in the inlet air port; ii) an outer piston having an annular crown, an inner cylinder wall defining an inner cylinder, and an annular outer sidewall extending from the periphery of the crown, the outer piston configured for reciprocating movement within the main cylinder; iii) an inner piston having a crown, and an annular inner sidewall extending from the periphery of the crown, the inner piston configured for reciprocating movement within the inner cylinder; iv) a securement means for securing selectively the outer piston with the main cylinder; and v) an optional coupling means for engaging selectively the inner piston with the outer piston for cooperative reciprocating movement within the main cylinder.

The present invention further provides a method for operating an internal combustion (IC) engine, the method comprising repeating a four-stroke cylinder cycle, the cycle comprising the steps of: a) providing the cylinder provided herein above, b) drawing in a combustion air into the inner cylinder while driving the inner piston within the inner cylinder, from proximate top dead center to proximate bottom dead center; c) compressing the combustion air by driving the inner piston within the inner cylinder, from proximate bottom dead center to proximate top dead center; d) injecting a fuel into the compressed combustion air; e) igniting the fuel; f) powering, by combustion of the ignited fuel in the fuel-air mixture, the inner piston and the outer piston simultaneously within the main cylinder from proximate top dead center, to bottom dead center; and g) exhausting the combustion gases by driving the inner piston and the outer piston simultaneously within the main cylinder, from proximate bottom dead center to proximate top dead center.

The present invention further provides a method for operating an internal combustion (IC) engine, the method comprising repeating a cylinder cycle, the cycle comprising the steps of: a) providing the cylinder provided herein above, b) drawing in a fuel-combustion air mixture into the inner cylinder while driving the inner piston within the inner cylinder, from proximate top dead center to proximate bottom dead center; c) compressing the fuel-combustion air mixture by driving the inner piston within the inner cylinder, from proximate bottom dead center to proximate top dead center; d) igniting the compressed fuel-combustion air mixture; e) powering, by combustion of the ignited fuel of the fuel-air mixture, the inner piston and the outer piston simultaneously within the main cylinder from proximate top dead center, to bottom dead center; and f) exhausting the combustion gases by driving the inner piston and the outer piston simultaneously within the main cylinder, from proximate bottom dead center to proximate top dead center.

The present invention further provides a method for operating an internal combustion (IC) engine, the method comprising repeating a cylinder cycle, the cycle comprising the steps of: a) providing the cylinder provided herein above, b) drawing in a fuel-combustion air mixture through an opened inlet port and a closed exhaust port, into the inner cylinder by driving the inner piston within the inner cylinder, from proximate top dead center to proximate bottom dead center; c) compressing the fuel-combustion air mixture by driving the inner piston within the inner cylinder, from proximate bottom dead center to proximate top dead center, with a closed inlet port and a closed exhaust port; d) igniting the compressed fuel-combustion air mixture; e) powering, by combustion of the ignited fuel of the fuel-air mixture, the inner piston and the outer piston simultaneously within the main cylinder from proximate top dead center, to bottom dead center, with a closed inlet port and a closed exhaust port; and f) exhausting the combustion gases through an opened exhaust port, by driving the inner piston and the outer piston simultaneously within the main cylinder, from proximate bottom dead center to proximate top dead center.

The co-annular dual piston cylinder can be operated at conventional compression ratios with a significant power output, particularly when operated with high velocity inlet air swirl flow, a stratified charge fuel injector spray, and a high energy ignition source. The operation of the co-annular dual piston cylinder delivers large reductions in the heat energy that is normally lost to the cooling system, and in the energy normally lost in the engine exhaust system.

DETAILED DESCRIPTION OF THE INVENTION

Figure 1:
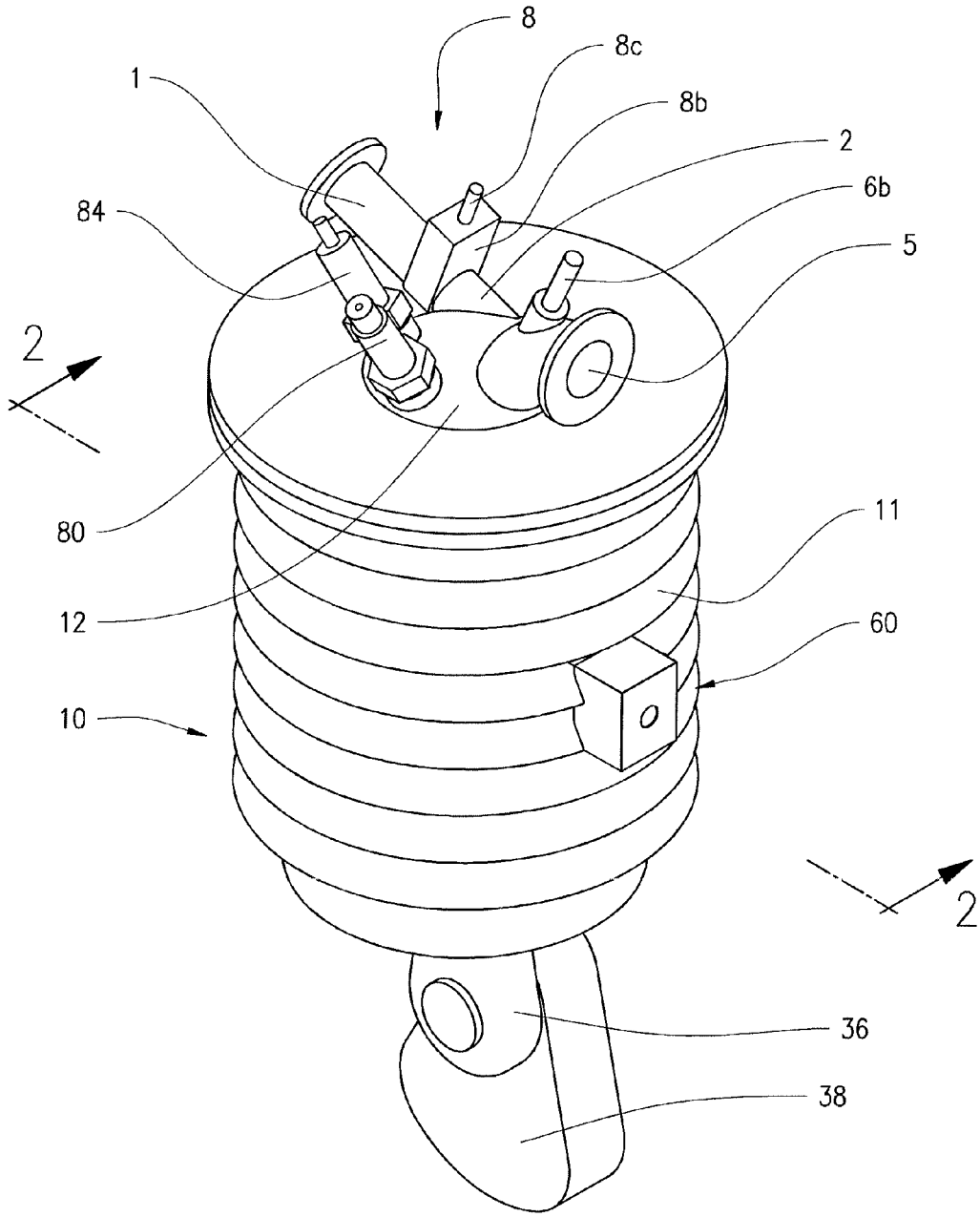
FIG. 1 shows a perspective view of the full-expansion, co-annular, dual-piston internal combustion (IC) cylinder of the present invention.

A cross-sectional view of the co-annular cylinder design is shown in FIG. 1 and illustrated in FIGS. 2-13. The co-annular cylinder includes an outer or main cylinder 10 that includes a main cylinder wall 14 and a cylinder head 12. The outer surface of the main cylinder wall 14 include cooling fins for dissipating head from the cylinder.

The cylinder head 12 has at least one exhaust port 4, an exhaust valve 6 disposed in the exhaust port for opening and closing fluid communication therethrough, and at least one inlet air port 2, and an inlet air valve 8 disposed in the inlet air port for opening and closing fluid communication therethrough. The cylinder head 12 includes an annular flange 13 that confronts and is secured sealingly to the annular flange 15 of the main cylinder 10, using bolts or similar fasteners.

The co-annular cylinder also includes an outer piston 20 that is configured for reciprocating movement within the main cylinder 10. The outer piston 20 includes an annular crown 22, an inner cylindrical wall 24 extending axially from the inner rim of the crown 22 and defining an inner cylinder 25 having a volume, and an annular outer sidewall 26 extending axially from the outer periphery of the crown 22. The inner cylindrical wall 24 and the outer sidewall 26 are co-annular and co-axial. The flange 13 of the cylinder head 12 can extend radially inward of the cylinder wall 14, and can cover the area of the crown 22 of the outer piston 20. In another embodiments, a portion of the crown 22 of the outer piston 20 is uncovered by the flange 13, and is exposed to the air space within the cylinder head 12.

The co-annular cylinder also includes an inner piston 30 having a crown 32, and an annular inner sidewall 34 extending from the periphery of the piston crown 32, and configured for reciprocating movement within the inner cylinder 25.

The co-annular cylinder also includes a securement means for securing selectively the outer piston 20 to the main cylinder 10, with the upper portion of the outer piston 20 proximate the cylinder head 12, during a portion of the engine cycle. The engagement means prevents the outer piston 20 from reciprocal movement away from the cylinder head 12 when the inner piston 30 reciprocates between a top-dead position, shown in FIG. 2, and a bottom-dead position shown in FIG. 4.

Figure 2:
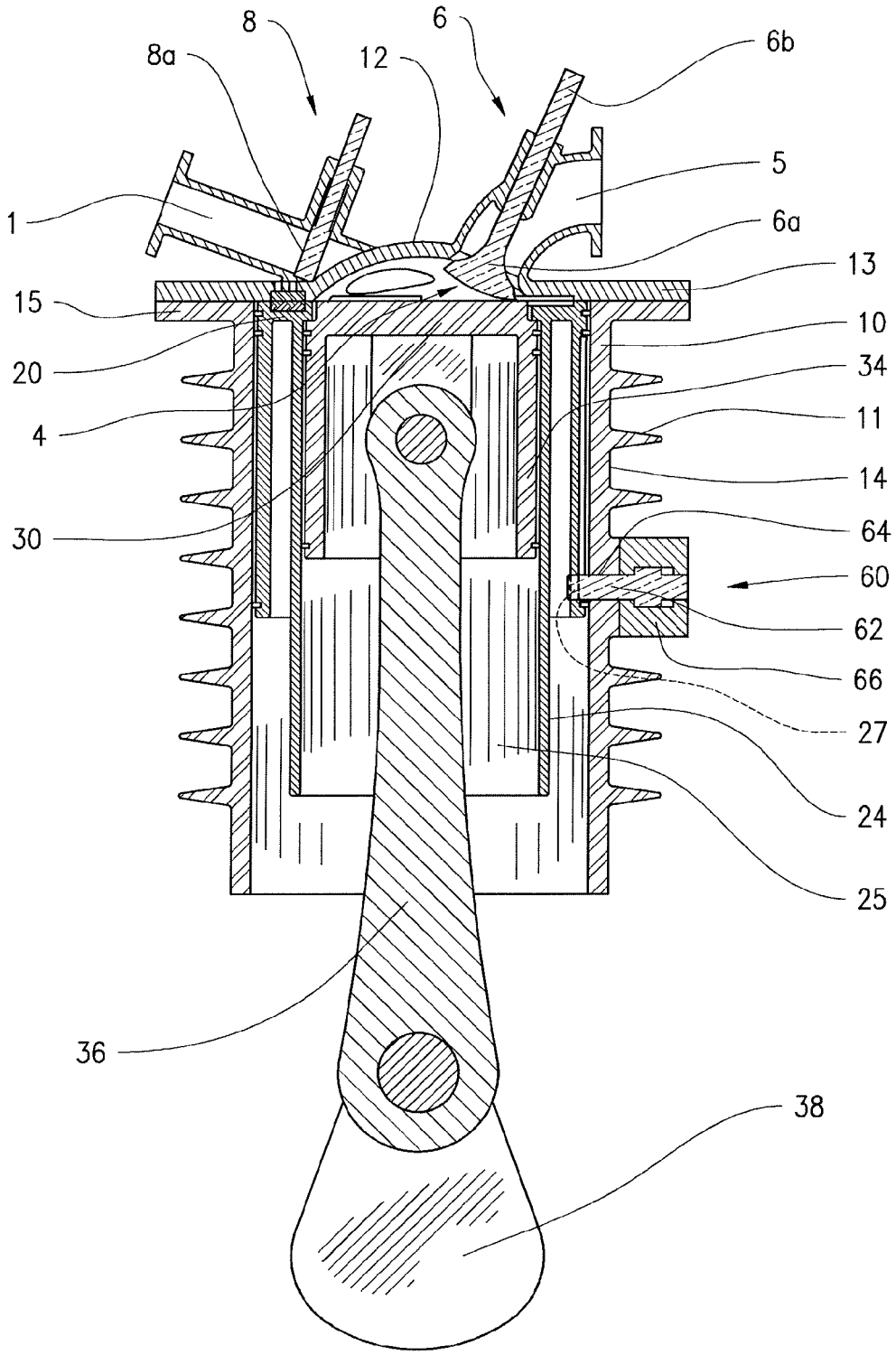
FIG. 2 shows the co-annular, dual-piston cylinder of FIG. 1, with an engagement pin securing the outer piston to the main cylinder, just before the start of the air intake stroke.
Figure 3:
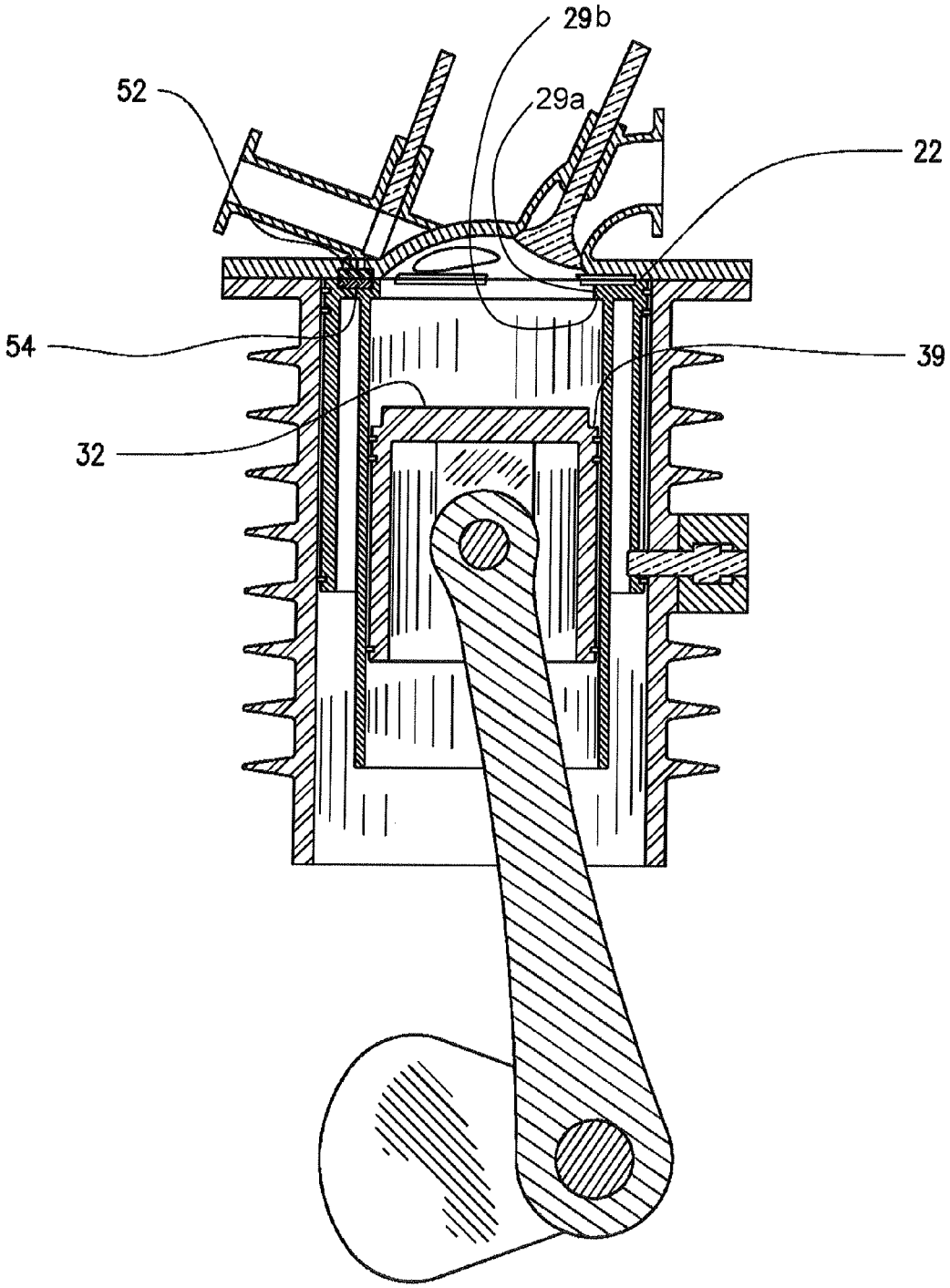
FIG. 3 shows the co-annular, dual-piston cylinder with the inner piston moving alone within the inner cylinder of the outer piston, along the air intake stroke.

A first embodiment of an engagement means includes a mechanical securement of the outer cylinder 10 to the outer piston 20. FIGS. 2 and 3 show an engaging device 60 disposed in the outer cylinder 10 that selectively engages the outer piston 20 and secures the outer piston 20 to the outer cylinder 10. The engaging device 60 includes a pin 62 that can extend from and between a first position that is out of engagement with the outer piston 20, as shown in FIGS. 7-11, and a second position engaged with the outer piston 20, as shown in FIG. 2-6. The pin 62 engages a bore 27 disposed in the inner cylindrical wall 24 of the outer piston 20. The movement of the pin 62 is an axial movement, inward from the outer cylinder 10. Movement of the pin 62 between the first position and the second position engaged in the bore 35, occurs when the crown 22 of the outer piston 20 is adjacent the cylinder head 12, as shown in FIGS. 2, 6, 7 and 11. FIG. 2-6 shows the pin 62 engaged within the bore 27 with the outer piston 20, which holds the outer piston 20 to the outer cylinder 10 while the inner piston 30 moves from top-dead center to top dead center through the air intake, compression and fuel injection and strokes or phases of the cylinder cycle. FIGS. 7-11 show the distal tip of the engagement pin 62 withdrawn to its second, disengaged position, which disengages the outer cylinder 10 from the outer piston 20, and specifically disengages or disconnects the outer sidewall 26 of the outer piston 20 from the outer cylinder 10. The distal tip of the engagement pin 62 can reside within a slot 28 in the outer sidewall 26 (FIGS. 7-10) to allow the outer piston 20 to move axially with the inner piston 30, and within the outer cylinder 10, during the ignition, combustion and power strokes or phases of the of the cylinder cycle.

An electrically powered and controlled solenoid 66 actuates the pin 62 between the first position and the second position. The solenoid can be dual-actuating, wherein the direction of the current flow through the solenoid is reversible, to drive the pin in both axial directions. The solenoid can also be single actuating, actuating and holding the pin in a single direction against the bias of a biasing means, which drives the pin in the opposite direction when actuating current is removed. The biased position is either the first or second position of the pin, and the biasing means can be a mechanical spring.

A second embodiment of an engagement means includes a magnet coupling, including a first magnetic member 52 disposed on the underside of the cylinder head 12, and a second magnetic member 54 disposed on the annular crown 22 of the outer piston 20. The first and second magnetic members have magnetically attractive forces when activated which assist to hold the outer piston 20 to the cylinder head 12. The magnetic members can be permanent magnets which exert attractive forces whenever the two magnetic members are in proximity. The magnetic members can also be selectively magnetic, and can include an electromagnetic coupling. Either one of the first or second magnetic members can be the magnetically active member, and the other is the magnetic-attracting member. In the illustrated embodiment, a plurality of the first magnetic members 52 are distributed annularly within the flange of the cylinder head 12, and a corresponding and registering plurality of the second magnetic members 54 are distributed annularly within the upper flange of the main cylinder head 10. Any number of the first and second magnetic members can be employed.

The co-annular cylinder also optionally includes a coupling means for engaging selectively the inner piston 30 with the outer piston 20 for cooperative reciprocating movement within the main cylinder 10. It is noted that the inner piston 30 is driven reciprocally by the crankshaft. In the configuration wherein the inner piston 30 and the inner cylinder 30 are both at top-dead center, against the cylinder head 12, and with the pin 62 out of engagement with the outer piston 20, the outer piston 20 is free to reciprocate within the main cylinder, and the coupling means engages the outer piston 20 for travel with the inner piston 30 from the top-dead position during the power stroke (as will be discussed below), as shown in FIGS. 7-11.

Figure 8:
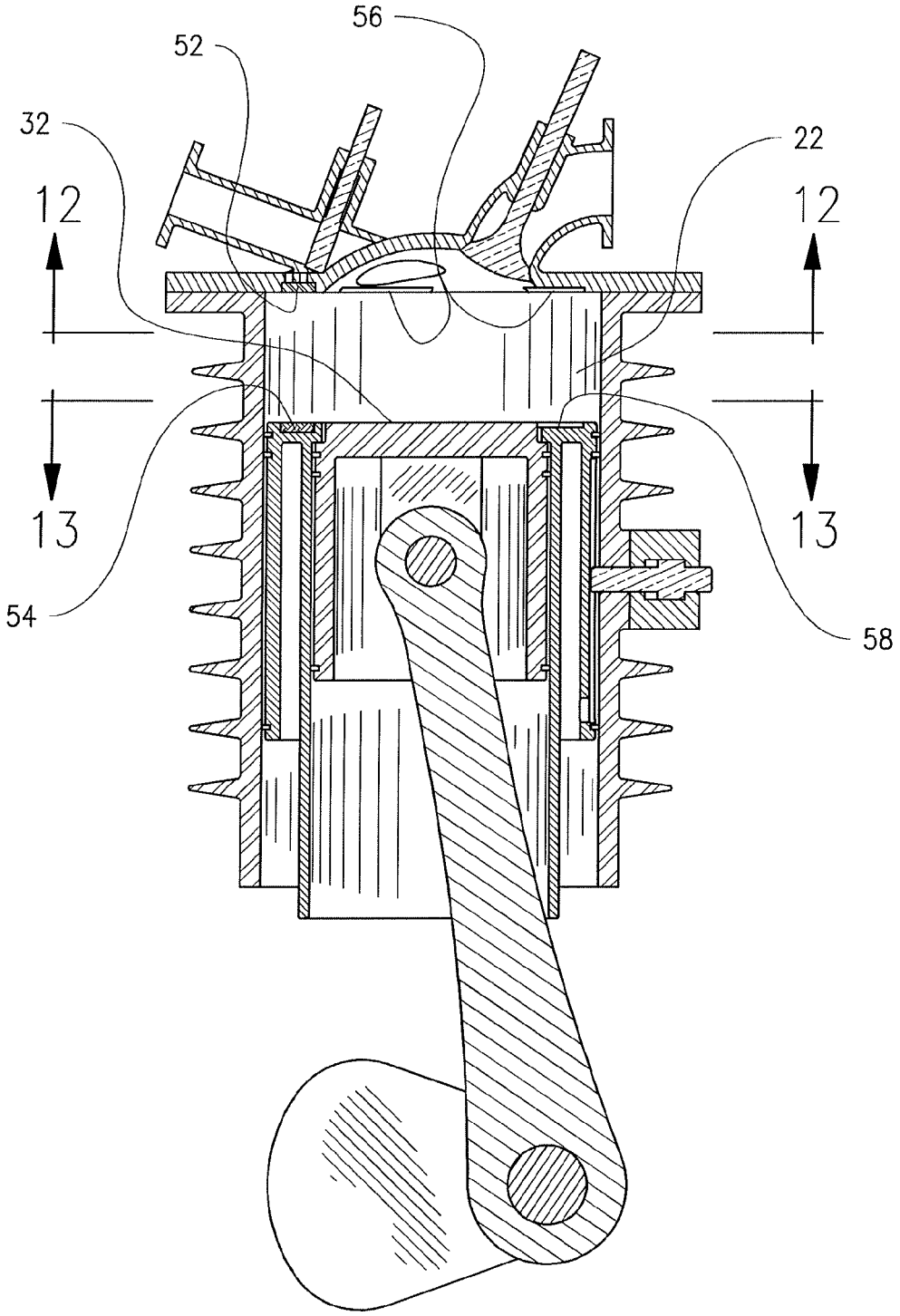
FIG. 8 shows the co-annular, dual-piston cylinder with the inner piston and the outer piston moving together through the power stroke.
Figure 12:
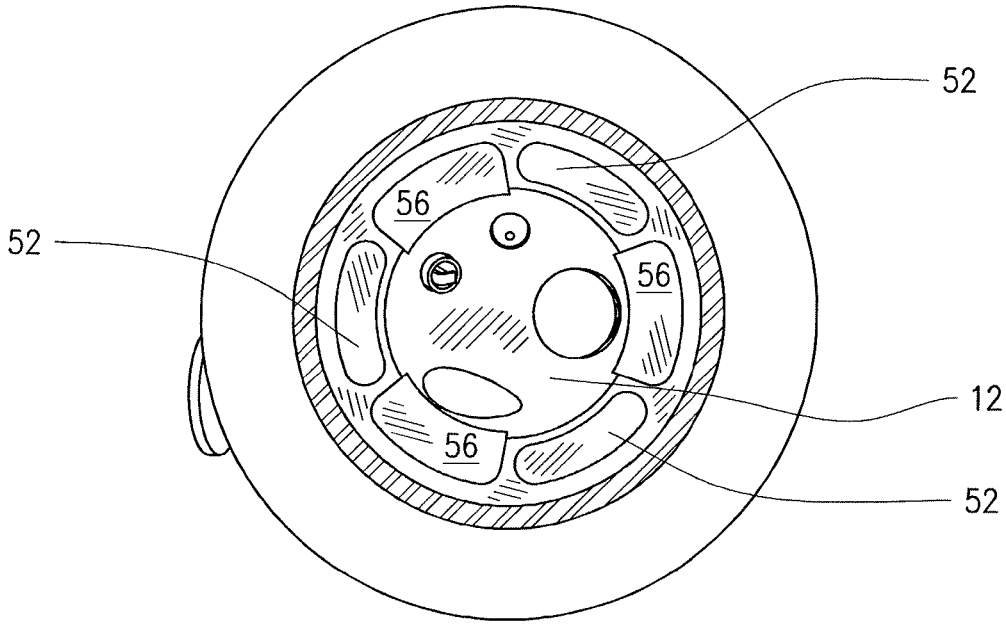
FIG. 12 shows an upward-looking sectional view of the upper portion of the main cylinder and the cylinder head, as viewed from line 12-12 in FIG. 8.
Figure 13:
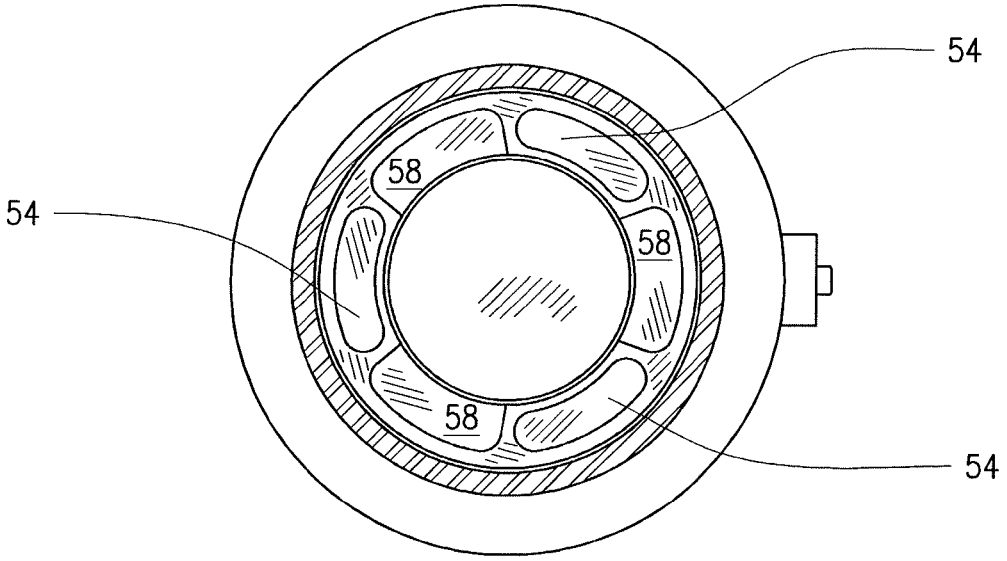
FIG. 13 shows a downward-looking sectional view of the lower portion of the outer cylinder, and the crowns of the outer piston and inner piston, as viewed from line 13-13 in FIG. 8.

To assist in moving the outer piston 20 away from the cylinder head 12 at the start of the power stroke (the outer piston is disengaged from the main cylinder 10), pressurized gases within the cylinder head 12 exert a downward force upon the crown 22 of the outer piston 20. In an embodiment wherein the flange 13 covers substantially the area of the crown 22, air cavities can be provide communication between the interior of the cylinder head airspace and at least a portion of the area of the crown 22 of the outer piston 20. FIGS. 8, 12 and 13 illustrate that one or more air cavities 56 can be formed in inner rim of the flange 13 of the cylinder head 12, to provide exposure of the pressurized gases within the cylinder head to an area of the crown 22. Alternatively, or in addition, one or more air cavities 58 can be formed into inner rim of the crown 22 of the outer piston 20, to provide exposure of the pressurized gases within the cylinder head to an area of the crown 22.

The outer or main cylinder 10 and the cylinder head 12 are air-cooled. The inner piston 30 is a conventional IC engine piston that has a connecting rod 36 attached to the engine crankshaft 38. The outer piston 20 has an annular crown 22 of about the same crown area as that of the crown 32 of the inner piston 30, which provides a power stroke volume that is about double the compression stroke volume provided by the inner piston 30 alone. The increased volume through the power stroke results in full expansion of the combustion gasses, toward and almost down to atmospheric pressure. For the intake stroke of the inner piston 30, airflow enters inters the cylinder volume through an inlet port 2 in the cylinder head 12, arranged for tangential inflow entry, along an inlet centerline tangential to the axial centerline of the cylinder, to provide turbulent, high velocity swirl flow of combustion air. This swirling airflow is then compressed to a high compression ratio, at the top of the cylinder with only the inner piston 30, where a fuel injector 80 injects a fuel 82 in a spray pattern in the downstream direction of the swirling, compressed combustion air, and a closely-spaced high-energy spark plug 84 ignites the rich center part of the stratified-charge fuel spray. For the power stroke, the co-annular outer piston 20 is secured selectively to the inner piston 30. A large exhaust valve 6 in the cylinder head 12 is used to exhaust the burned combustion gases, with both of the pistons 20 and 30, through the cylinder 10 during the exhaust stroke.

Figure 4:
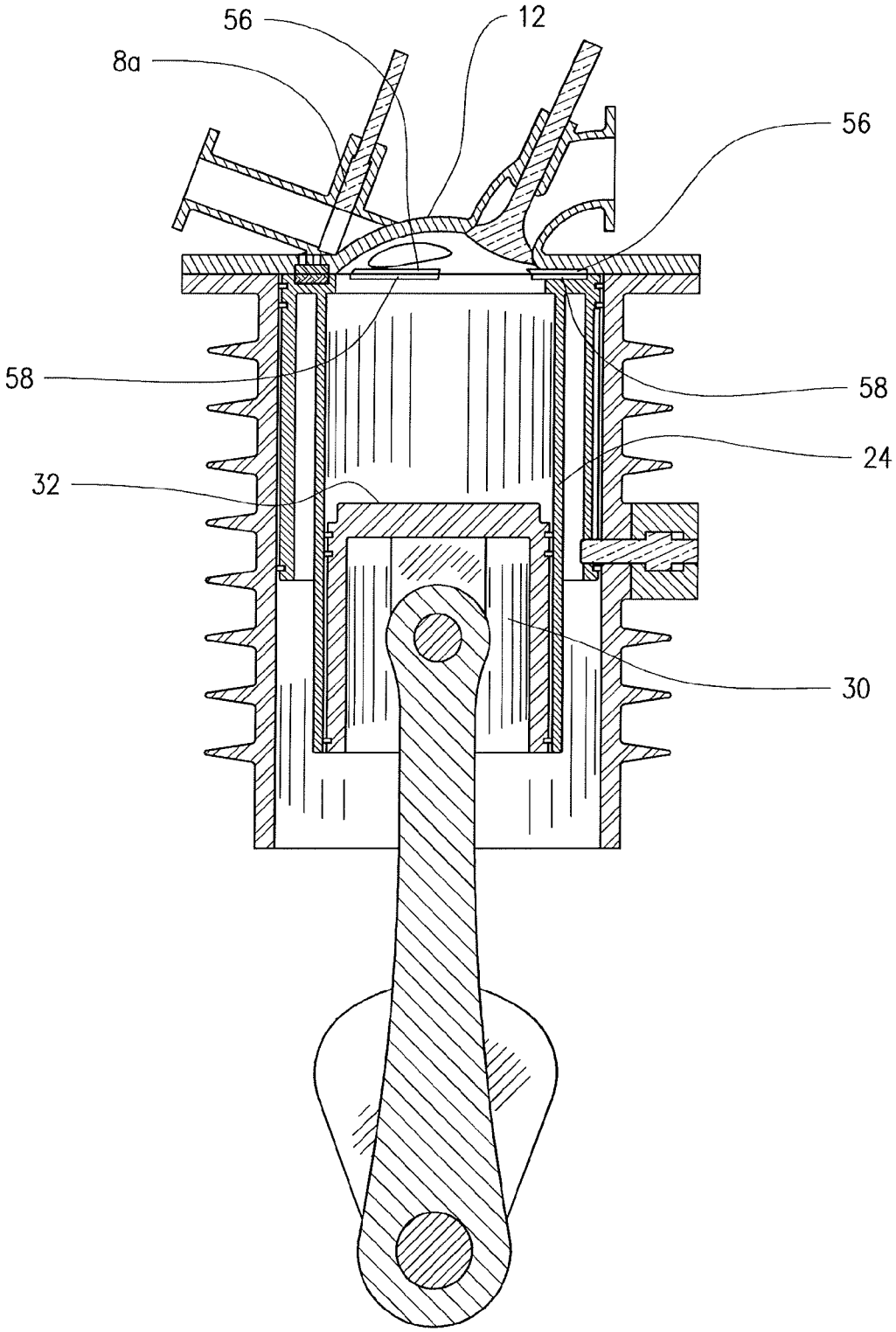
FIG. 4 shows the co-annular, dual-piston cylinder with the inner piston moving alone within the inner cylinder of the outer piston at bottom dead center, at the end of the air intake stroke and just before the air compression stroke.
Figure 5:
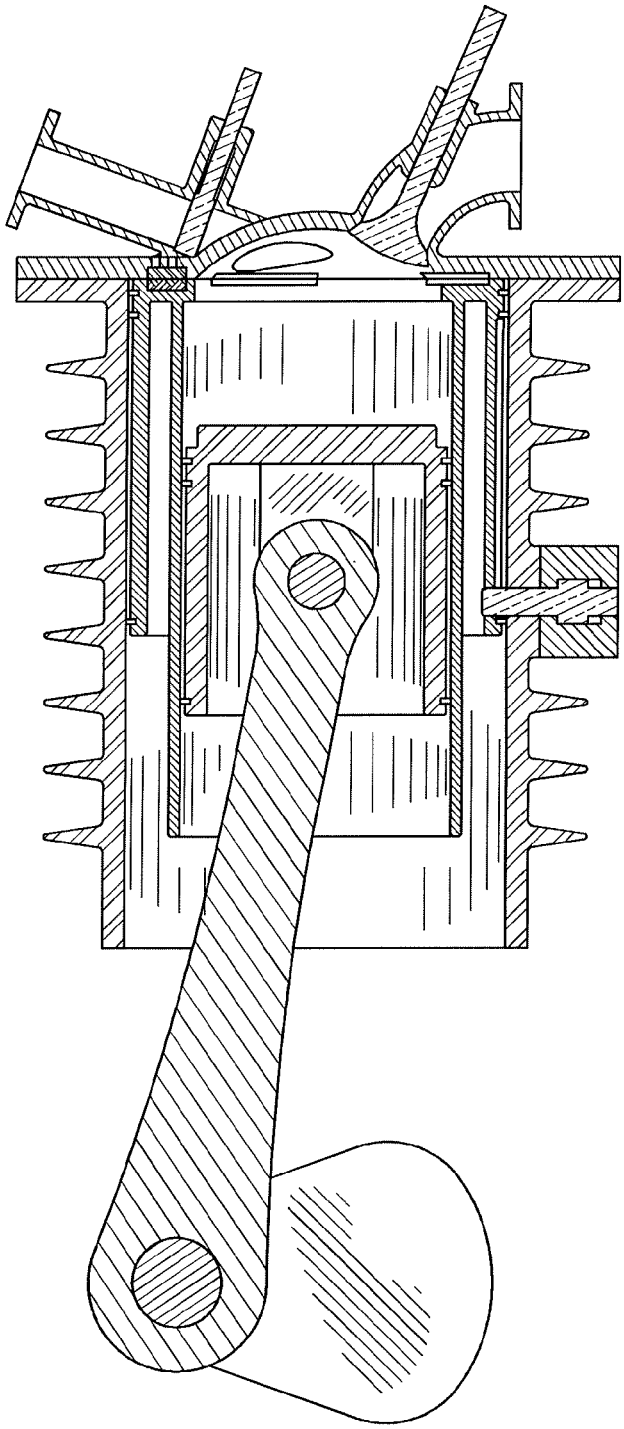
FIG. 5 shows the co-annular, dual-piston cylinder with the inner piston moving alone within the inner cylinder of the outer piston, through the air compression stroke.
Figure 6:
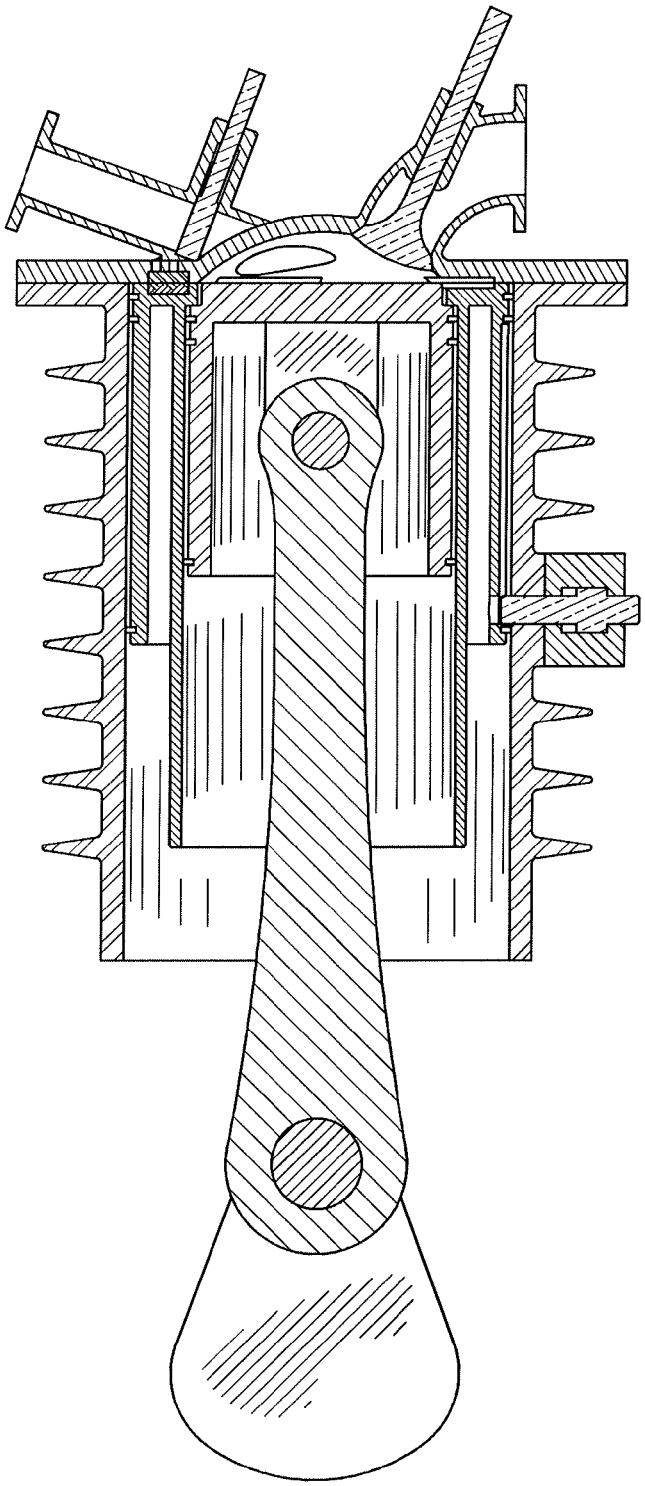
FIG. 6 shows the co-annular, dual-piston cylinder with the inner piston and the outer piston at top-dead center, at the end of the air compression stroke and just after fuel injection and ignition.

The present invention provides a method for operating an internal combustion (IC) engine having full-expansion, co-annular, dual-piston cylinders, comprising repeating a four-stroke cylinder cycle that includes air intake, air compression, fuel injection, ignition, combustion, power and exhaust. The objective of the co-annular, dual piston cylinder is to operate with only the inner piston during the two strokes of air intake and air compression, and with both co-annular pistons during the two strokes of fuel combustion, power and exhaust FIGS. 2 and 3 show the outer piston 20 engaged with the main cylinder 10, and the engagement pin 62 engaging bore 27, as the inner piston commences the air inlet phase of the cycle. With the exhaust valve 6 closed and the inlet valve 8 opened, inlet or combustion air is drawn in by driving (pulling, via the crankshaft) the inner piston 30 within the inner cylinder 25 from proximate top dead center (FIG. 2, crank angle approximately 0 degrees) through the air intake stroke (FIG. 3) to proximate bottom dead center (FIG. 4, crank angle approximately 180 degrees). At bottom dead center, the inner piston 30 has drawn into the cylinder a volume (Vi) of combustion air which is slightly above atmospheric pressure or the pressure as delivered by a supercharger, if used. This combustion volume Vi is the sum of the volume within the inner cylinder 24 above the piston crown 32 (Vcylinder), and the volume within the cylinder head 12 (substantially the volume above the piston crown 22 at top dead center) including the inlet air port out to the valve 8*a* when closed (Vhead). After closing the inlet air valve 8, the volume Vi of combustion air is compressed within the inner cylinder 25, by driving (pushing, via the crankshaft) the inner piston 30 within the inner cylinder 25 from bottom dead center (crank angle approximately 180 degrees) through the compression stroke (FIG. 5), to proximate top dead center (FIG. 6, crank angle about 345-360 degrees). At proximate top dead center, the volume of the compressed combustion air (Vii) is the volume Vhead. The cylinder diameter and piston stroke length, the shape of the cylinder head, and the selection of inlet and outlet valves, are designed to provide a ratio of volume Vii of compressed combustion air to volume Vi of inlet combustion air of between 15:1 and 25:1, and typically about 20:1.

Figure 7:
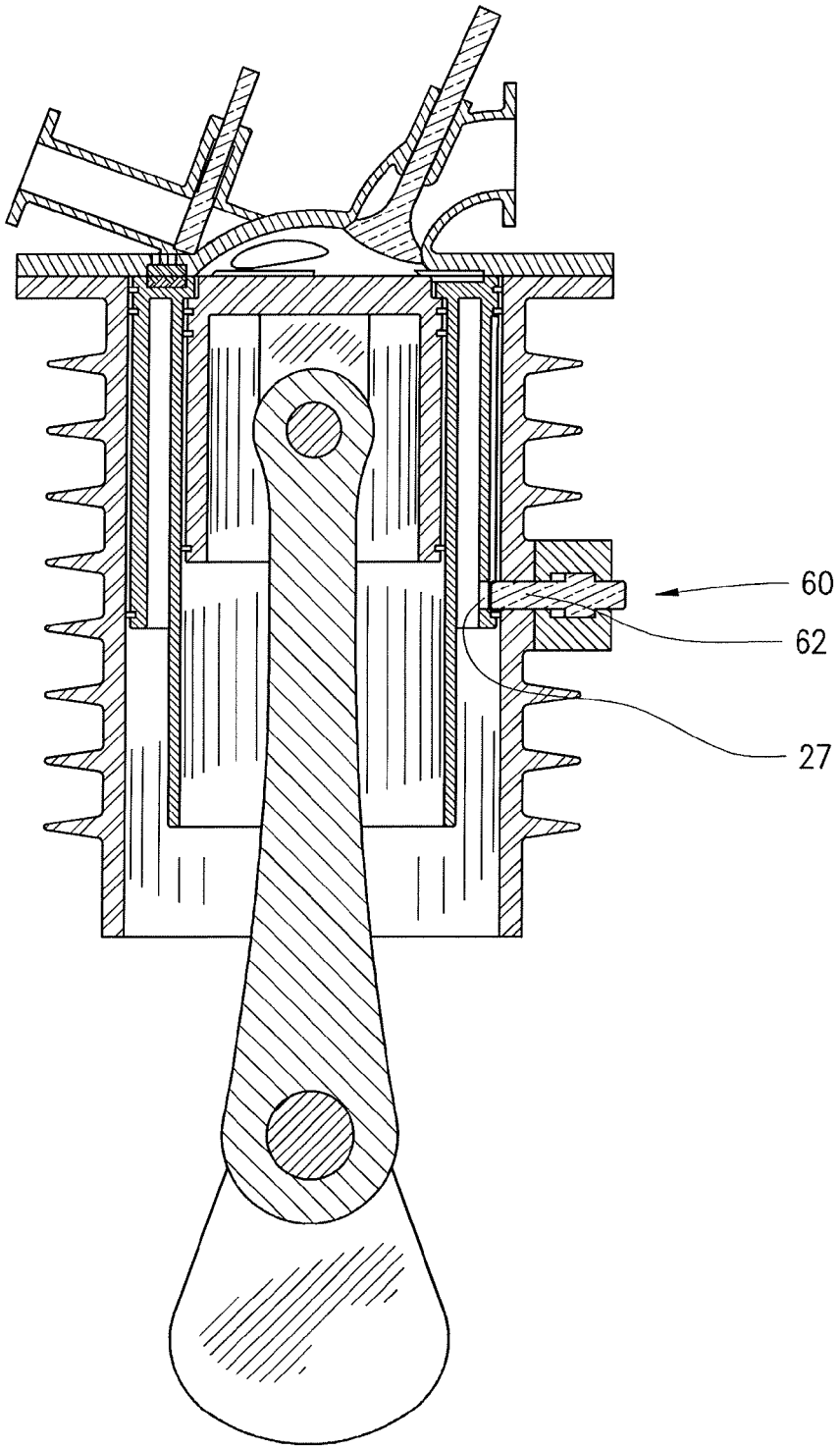
FIG. 7 shows the co-annular, dual-piston cylinder with the engagement pin disengaged from the outer piston, at the beginning of the combustion and power stroke.
Figure 9:
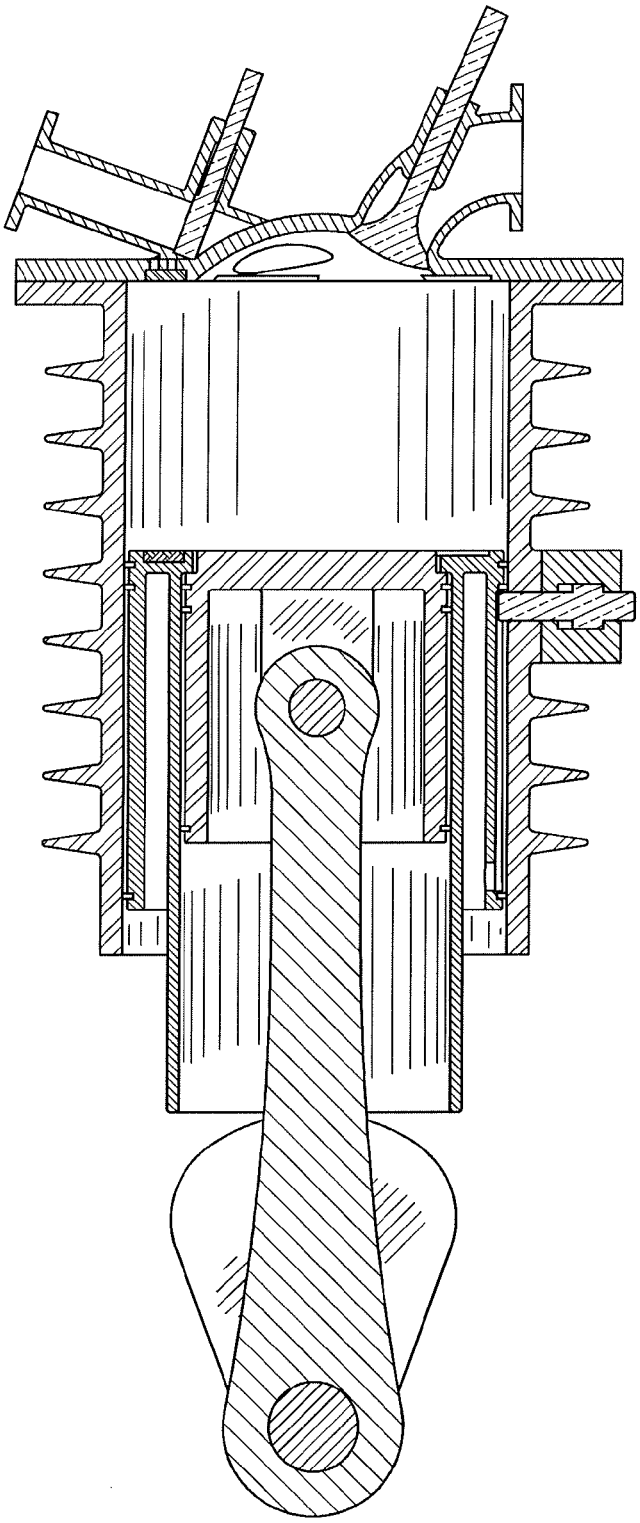
FIG. 9 shows the co-annular, dual-piston cylinder with the inner piston and the outer piston moving together at bottom dead center, at the end of the power stroke.
Figure 10:
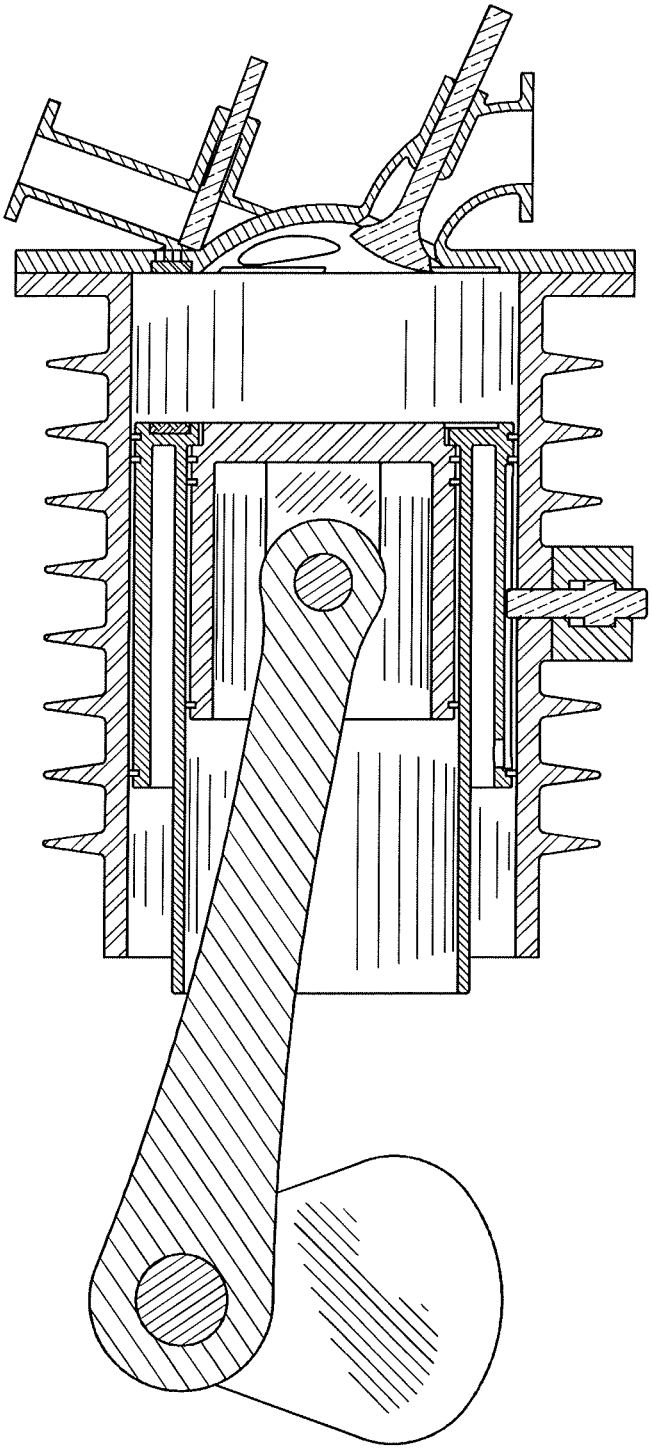
FIG. 10 shows the co-annular, dual-piston cylinder with the inner piston and the outer piston moving together through the exhaust stroke.

At this point, the engaging pin 62 remains within the bore 27 to secure the outer piston 20 to the outer housing 10. Fuel is then injected into the compressed combustion air as the crank angle continues moving toward top dead center, crank angle 360 degrees). Near top dead center, the engaging means is disengaged; as shown in FIG. 7, the engagement pin 62 is withdrawn from the bore 27 in the outer piston 20, releasing the outer piston 20 from the main cylinder 10, and allowing movement of the outer cylinder 20 within the main cylinder 10. The fuel is then ignited by a spark means, and the fuel begins to combust. The combusting fuel rapidly produces expanding combustion gases and heat, and dramatically increasing the gas pressure within the cylinder, beneath the cylinder head. As the inner piston 30 begins drawing away from cylinder head (top dead center), driven by combustion gas pressure, the outer piston 20 travels axially with the inner piston 30, exposing the increased surface area of the crowns 22 and 32 of both the outer piston 20 and the inner piston 30 ahead of the driving pressure of the combustion gases. Typically, a portion of the crown 22 of the outer piston 20 is exposed to the air space within the cylinder head 12. Optionally, to aid initiating movement of the outer piston 20 away from the cylinder head 12, cavities 56 can be formed into the cylinder head 12, extending radially outward and above the crown 22 of the outer cylinder 20, and/or cavities 58 can be formed radially into the crown 22 of the outer piston 20. The air cavities 56 and/or 58 provide communication of pressurized gases over the area of the crown 22, which initiates driving the outer piston 20 downward at the start of the power stroke. The combustion gases continue driving the outer piston 20 and inner piston 30 within the inner cylinder 25 from just past top dead center (crank angle 180-190 degrees) through the power stroke (FIG. 8), to proximate bottom dead center (FIG. 9, crank angle about 540 degrees). The larger expansion volume of the outer cylinder volume reduces the internal gas pressure to low pressures, substantially lower than conventional cylinder, and approaching atmospheric pressure. This feature optimizes the extraction and conversion of energy from combustion gas pressure to engine crankshaft power. At bottom dead center of the power stroke, the conjoint outer piston 20 and inner piston 30 define a volume (Viii) within the outer cylinder 10 of exhausted combustion gases which is above though approaching atmospheric pressure. This exhaust gas volume Viii is the sum of the volume within the outer cylinder 10 above the piston crowns 22 and 32 (Vdualcylinders), and the volume Vhead. The inner and outer piston diameters and stroke length are designed to provide a ratio of volume Viii of exhausted combustion gases to volume Vi of inlet combustion air of between 1.5:1 and 2.5:1, and typically about 2:1. The area of the crown 22 of the outer piston 20 is typically about 50% to about 150% the area of the crown 32 of the inner piston 30. If the volume Vhead is minimized, the volume Vdualcylinder is typically about twice the volume Vcylinder, and the area of the crown 22 of the outer piston 20 is about the same as the area of the crown 32 of the inner piston 30.

Figure 11:
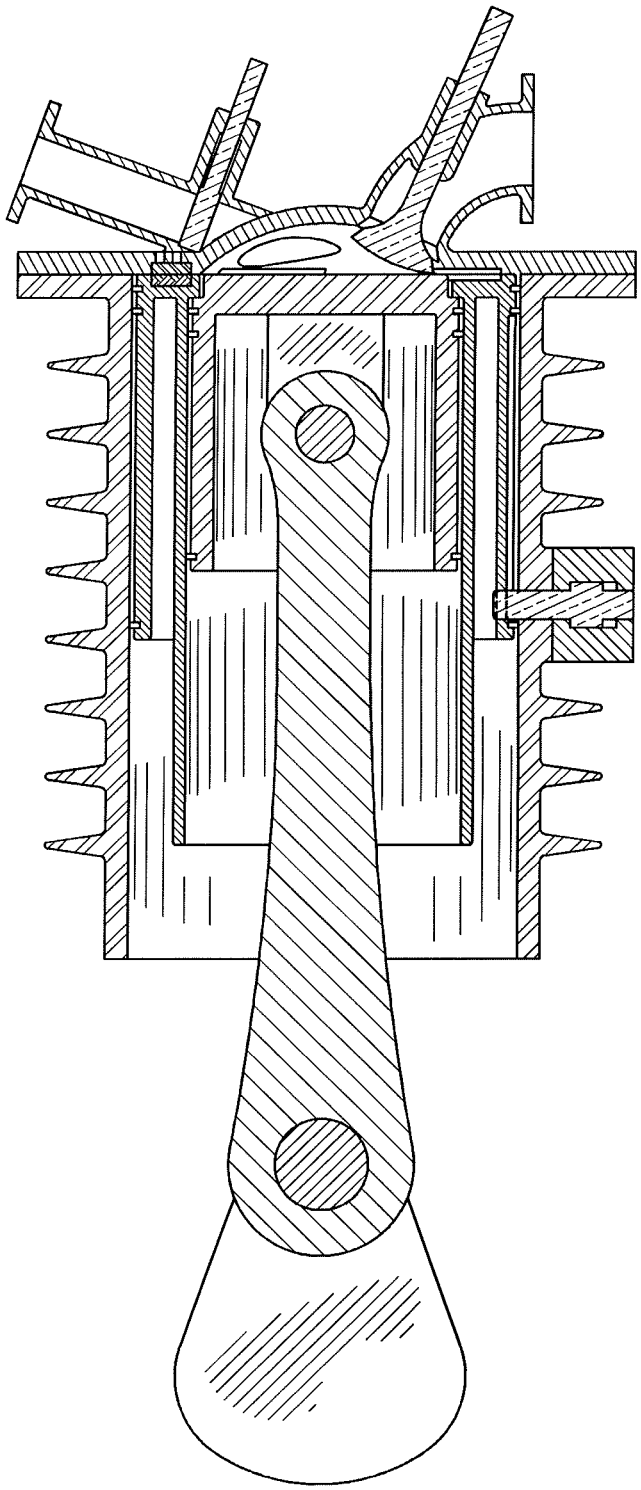
FIG. 11 shows the co-annular, dual-piston cylinder with the inner piston and the outer piston at top-dead center, at the end of the exhaust stroke, with the engagement pin disengaged.

As the pistons progress past bottom dead center, the exhaust valve 6 is opened so that the spent combustion gases can be exhausted during the exhaust stroke (FIG. 10), and to a position approaching top dead center (FIG. 11, crank angle about 700-720 degrees). The inner piston 30 is being driven by the crankshaft, and the outer periphery of the inner piston crown 32 has an annular shoulder 39 that engages an annular recess 29*b* along the inner rim 29*a* of the outer piston crown 22 of the outer piston 20, to positively drive the outer piston 20 with the driven inner piston 30. At or near top dead center, the engagement pin 62 is activated to engage bore 27, which locks the outer piston 20 to the outer housing 10. The exhaust valve 6 then closes, and the inlet air valve opens to reinitiate the cylinder cycle.

In another aspect of the invention, the four-stroke cylinder cycle of the invention can include the steps of: drawing in a fuel-combustion air mixture into the inner cylinder while driving the inner piston within the inner cylinder, from proximate top dead center to proximate bottom dead center; compressing the fuel-combustion air mixture by driving the inner piston within the inner cylinder, from proximate bottom dead center to proximate top dead center, with the inlet and exhaust valves closed; igniting the compressed fuel-combustion air mixture; powering, by combustion of the ignited fuel of the fuel-air mixture, both the inner piston and the outer piston simultaneously within the main cylinder from proximate top dead center, to bottom dead center, to a pressure approaching atmospheric; and exhausting the combustion gases by driving the inner piston and the outer piston simultaneously within the main cylinder, from proximate bottom dead center to proximate top dead center.

In another aspect of the invention, the four-stroke cylinder cycle of the invention can include the steps of: drawing in a fuel-combustion air mixture through an opened inlet port and a closed exhaust port, into the inner cylinder by driving the inner piston within the inner cylinder, from proximate top dead center to proximate bottom dead center; compressing the fuel-combustion air mixture by driving the inner piston within the inner cylinder, from proximate bottom dead center to proximate top dead center, with a closed inlet port and a closed exhaust port; igniting the compressed fuel-combustion air mixture; powering, by combustion of the ignited fuel of the fuel-air mixture, the inner piston and the outer piston simultaneously within the main cylinder from proximate top dead center, to bottom dead center, with a closed inlet port and a closed exhaust port; and exhausting the combustion gases through an opened exhaust port, by driving the inner piston and the outer piston simultaneously within the main cylinder, from proximate bottom dead center to proximate top dead center.

FIGS. 2 and 3 illustrate an inlet air port 2 and an inlet air valve 8 disposed in the inlet air port for opening and closing inlet air communication with the cylinder. The illustrated inlet air valve is a sliding plate valve. A sliding plate valve is disclosed in U.S. Provisional Patent Application 61/691,843, the disclosure of which is incorporated by reference in its entirety. The sliding gate valve provides a rapid means for opening the full cross-section of the inlet port to inlet air flow, which improves the air swirling pattern within the cylinder. An alternative inlet air port and valve is a rotary valve, such as one disclosed in U.S. Provisional Patent Application 61/691,842, the disclosure of which is incorporated by reference in its entirety.

Alternatively, the illustrated conventional poppet-type exhaust valve can be replaced with a sliding plate or rotary valve.

The present invention also provides a stratified fuel charge and rapid ignition with high velocity air swirl flow, which provides a very short combustion delay time with more energy released at the top of the stroke, resulting in high thermal efficiency. With no premixed fuel, there is no region in the cylinder where the high compression ratio can cause detonation or pre-ignition. Also, with stratified charge and high energy spark ignition, many different kinds of fuel can be used. U.S. Pat. No. 8,051,830 and U.S. Patent Application Publication 2012-0174881, the disclosures of which are incorporated by reference in their entireties, disclose a stratified fuel charge and combustion. With this combustion concept, the engine power output is controlled by the fuel flow. To reduce combustion temperatures, the fuel is burned at reduced fuel-air ratios at the design power output. With TBC coatings on the inside of the cylinder head and on the piston crowns, the reduced temperatures result in large reductions of heat losses from the cylinders, especially at low power cruise conditions. Also, NOx, HC and CO emissions are reduced, and there are no smoke or soot emissions with Diesel fuel. Nearly all of the available energy that is normally lost in the exhaust system is recovered with the full expansion concept, and with the engine power controlled by the fuel flow, airflow restrictions are eliminated and pressure losses in the air intake system are reduced. Thermodynamic cycle studies for this engine concept show that the fuel consumption will be reduced to about 55% of conventional IC engines with the same power output and the cost of this full expansion engine will be considerably less than for turbo-charged engines with exhaust driven power turbines that have the same efficiency.

I claim:

1. A cylinder for a four-stroke internal combustion (IC) engine having co-annular dual pistons, the cylinder including:

i) a main cylinder including a main cylinder wall and a cylinder head, and having at least one exhaust port, an exhaust valve disposed in the exhaust port, and at least one inlet air port, and an inlet air valve disposed in the inlet air port;

ii) an outer piston having an annular crown, an inner cylinder wall defining an inner cylinder, and an annular outer sidewall extending from the periphery of the crown, the outer piston configured for reciprocating movement within the main cylinder;

iii) an inner piston having a crown, and an annular inner sidewall extending from the periphery of the crown, the inner piston configured for reciprocating movement within the inner cylinder; and iv) a securement configured for securing the outer piston with the main cylinder through an intake stroke and a compression stroke, and for disengagement of the outer piston with the main cylinder through a combustion and power stroke and an exhaust stroke.

2. A method for operating an internal combustion (IC) engine, the method comprising providing the cylinder according to claim 1 and repeating a cylinder cycle, the cycle comprising the steps of:

a) securing the outer piston with the main cylinder;

b) drawing in a combustion air into the inner cylinder while driving the inner piston within the inner cylinder, from proximate top dead center to proximate bottom dead center;

c) compressing the combustion air by driving the inner piston within the inner cylinder, from proximate bottom dead center to proximate top dead center;

d) injecting a fuel into the compressed combustion air;

e) igniting the fuel;

f) disengaging the outer piston with the main cylinder;

g) powering, by combustion of the ignited fuel in the fuel-air mixture, the inner piston and the outer piston simultaneously within the main cylinder from proximate top dead center, to bottom dead center; and h) exhausting the combustion gases by driving the inner piston and the outer piston simultaneously within the main cylinder, from proximate bottom dead center to proximate top dead center.

3. A method for operating an internal combustion (IC) engine, the method comprising providing the cylinder according to claim 1 and repeating a cylinder cycle, the cycle comprising the steps of:

a) securing the outer piston with the main cylinder;

b) drawing in a fuel-combustion air mixture into the inner cylinder while driving the inner piston within the inner cylinder, from proximate top dead center to proximate bottom dead center;

c) compressing the fuel-combustion air mixture by driving the inner piston within the inner cylinder, from proximate bottom dead center to proximate top dead center;

d) igniting the compressed fuel-combustion air mixture;

e) disengaging the outer piston with the main cylinder;

f) powering, by combustion of the ignited fuel of the fuel-air mixture, the inner piston and the outer piston simultaneously within the main cylinder from proximate top dead center, to bottom dead center; and g) exhausting the combustion gases by driving the inner piston and the outer piston simultaneously within the main cylinder, from proximate bottom dead center to proximate top dead center.

4. The method according to claim 3, wherein the fuel-combustion air mixture is through the opened inlet port with the exhaust port closed, the compressing is with the inlet port closed and the exhaust port closed, and the exhausting is through the opened exhaust port.

5. The cylinder according to claim 1 wherein the securement is a mechanical securement.

6. The cylinder according to claim 5 wherein the mechanical securement is a pin that can extend from and between a first position that is out of engagement with the outer piston, and a second position engaged with the outer piston.

7. The cylinder according to claim 6 wherein the pin extends between the first position and the second position by actuation of an electrically powered and controlled solenoid.

8. The cylinder according to claim 1 wherein the securement is a magnetic securement.

9. The cylinder according to claim 1, wherein the annular crown of the outer piston includes an inner rim that forms an annular recess, and the periphery of the crown of the inner piston includes an annular shoulder that engages the annular recess.

10. The cylinder according to claim 1, wherein the annular crown of the outer piston has a plurality of air cavities in fluid communication with an airspace in the cylinder head.

11. The cylinder according to claim 1, wherein an area of the annular crown of the outer piston is about 50% to about 150% of an area of the crown of the inner piston.

12. The cylinder according to claim 11, wherein the area of the annular crown of the outer piston is about the same as the area of the crown of the inner piston.

* * * * *